United States Patent [19]

Hartmann et al.

[11] Patent Number: 4,923,006

[45] Date of Patent: May 8, 1990

[54] INSULATING SUPPORT FOR TUBING STRING

[75] Inventors: Michael P. Hartmann; Jerry D. Smith, both of Houston, Tex.

[73] Assignee: Cameron Iron Works USA, Inc., Houston, Tex.

[21] Appl. No.: 373,093

[22] Filed: Aug. 7, 1989

[51] Int. Cl.[5] ..... E21B 33/03; E21B 33/04

[52] U.S. Cl. ..... 166/65.1; 166/75.1; 166/208; 166/382; 285/140

[58] Field of Search ..... 166/57, 65.1, 60, 208, 166/382, 387, 75.1, 368; 285/140, 142, 143, 138, 923, 423

[56] References Cited

U.S. PATENT DOCUMENTS

| | | | |
|---|---|---|---|
| 2,244,256 | 6/1941 | Looman | 166/60 |
| 2,597,261 | 5/1952 | Rhoads | 219/39 |
| 2,667,626 | 1/1954 | Blancher | 340/18 |
| 2,728,396 | 12/1955 | Carpenter | 166/60 |
| 2,812,818 | 11/1957 | Brusco | 166/60 |
| 2,896,972 | 7/1959 | Zauertnik | 285/50 |
| 2,982,354 | 5/1961 | Green | 166/60 |
| 3,294,169 | 12/1966 | O'Brien | 166/65.1 X |
| 4,154,302 | 5/1979 | Cugini | 166/315 |
| 4,487,257 | 12/1984 | Dauphine | 166/60 |
| 4,627,489 | 12/1986 | Reed | 155/65.1 |
| 4,716,969 | 1/1988 | Eastland et al. | 166/60 |
| 4,804,045 | 2/1989 | Reed | 166/65.1 |

*Primary Examiner*—Stephen J. Novosad

[57] ABSTRACT

An improved wellhead structure having a housing with an internal landing seat to receive the landing shoulder on a hanger having a bore with a counterbore below the bore and a shoulder between, a hanger mandrel positioned within the counterbore and having an external flange having a diameter less than the diameter of the counterbore, a first bushing positioned above the mandrel flange and in engagement with said shoulder within the hanger counterbore, a second bushing positioned within the counterbore below said mandrel flange, and a support sleeve positioned within said hanger in supporting relationship to said second bushing, said bushings being of an electrical insulating material and sized to retain said mandrel in spaced relationship with respect to said hanger to prevent electrical connection therebetween. This structure also is used for supporting and sealing a tubing string or a section of a tubing string in a well while electrically insulating the section from the remainder of the string.

16 Claims, 5 Drawing Sheets

INSULATING SUPPORT FOR TUBING STRING

BACKGROUND

The present invention relates to an improved structure for supporting and sealing a tubing string or a portion of a tubing string in a well and electrically insulating the tubing string or the portion of the tubing string from the remainder of the support structure or the tubing string.

In the production of oil and gas from wells, paraffin problems often appear. In treating such problems so that the paraffin does not build up sufficiently to create a restriction to the production the heating of the production string has commonly been attempted.

The I. C. Looman U.S. Pat. No. 2,244,256 discloses the removal of congealed paraffin and asphaltic bodies in oil wells and suggest the electrical heating of the wells. In this structure the tubing string hanger is insulated from the housing in which it lands by an annulus 19 of electrically insulating material preventing electric contact between the hanger and the housing. Additionally spaced insulators are mounted on the exterior of the tubing string and function as an insulating centralizer.

The L. H. Rhoads U.S. Pat. No. 2,597,261 discloses another similar structure in which an insulating bushing is provided between the cap at the upper end of the casing and the pipe line with additional insulating collars on the pipe line within the casing. This allows the use of an electric current passing through the pipe line to heat the paraffinic and sulphatic substances to maintain them in a free-flowing condition.

The C. A. Carpenter U.S. Pat. No. 2,728,396, the W. G. Green U.S. Pat. No. 2,982,354, the J. P. Brusco U.S. Pat. No. 2,812,818, the T. C. Dauphine U.S. Pat. No. 4,487,257 and B. J. Eastlund et al U.S. Pat. No. 4,716,960 all disclose similar insulating structures for the use of an electric current to maintain the well fluids in a free-flowing condition to allow maximum production.

The D. W. Blancher U.S. Pat. No. 2,667,626 discloses a telemetering system in which an insulating sleeve is used to provide the electrical insulation.

The E. T. Cugini U.S. Pat. No. 4,154,302 discloses an electric cable feed-through structure and the M. G. Zavertnik U.S. Pat. No. 2,896,972 discloses an insulating structure for insulating the tubular support of a hanging light fixture from the electric splice box.

SUMMARY

The present invention is directed to a wellhead structure which allows an electrical current to be conducted into the well tubing string or a portion of the tubing string to heat any paraffin accumulation. One form of this structure includes a well housing having an internal landing seat, a hanger having an external landing shoulder for landing on the housing landing seat, the hanger having an upper bore and a lower counterbore therethrough with a downwardly facing shoulder therebetween, a tubular hanger mandrel positioned within the hanger counterbore and having an upper annular external flange extending around the upper portion of the hanger mandrel and positioned a short distance below the upper end of the hanger mandrel, a support sleeve secured within the lower portion of the hanger counterbore in surrounding relationship to a portion of the hanger mandrel below said mandrel flange and having an upper supporting surface, a pair of annular insulating bushings, one of said bushings positioned between the lower surface of said mandrel flange and the sleeve support surface and the other bushing positioned around the upper portion of said mandrel above said hanger flange and extending upwardly beyond the upper end of the hanger mandrel, and sealing means associated with said bushings to provide a seal between said mandrel and said hanger. In another form of the invention this structure is provided to connect a section in a tubing string and to insulate such section from the remainder of the tubing string above and below the section and from the other well structure.

An object of the present invention is to provide an improved tubing insulation structure for a wellhead to allow the use of electric heating of the well.

Another object of the present invention is to provide an improved wellhead structure which both supports and insulates tubing from the hanger and housing.

A further object of the present invention is to provide an improved wellhead structure for supporting and insulating the tubing in which the insulators transfer the tubing weight to the hanger and also provide for aligning the tubing with respect to the hanger.

Still another object of the present invention is to provide an improved tubing support structure to maintain or seal pressure from the inside to the outside of a tubing string.

Still another object of the present invention is to provide an improved insulating support structure which electrically isolates a section of tubing string from the remainder of the tubing string.

BRIEF DESCRIPTION OF THE DRAWINGS

These and other objects of the present invention are hereinafter described and explained with reference to the drawings wherein.

DESCRIPTION OF THE PREFERRED EMBODIMENT

Figure 1:
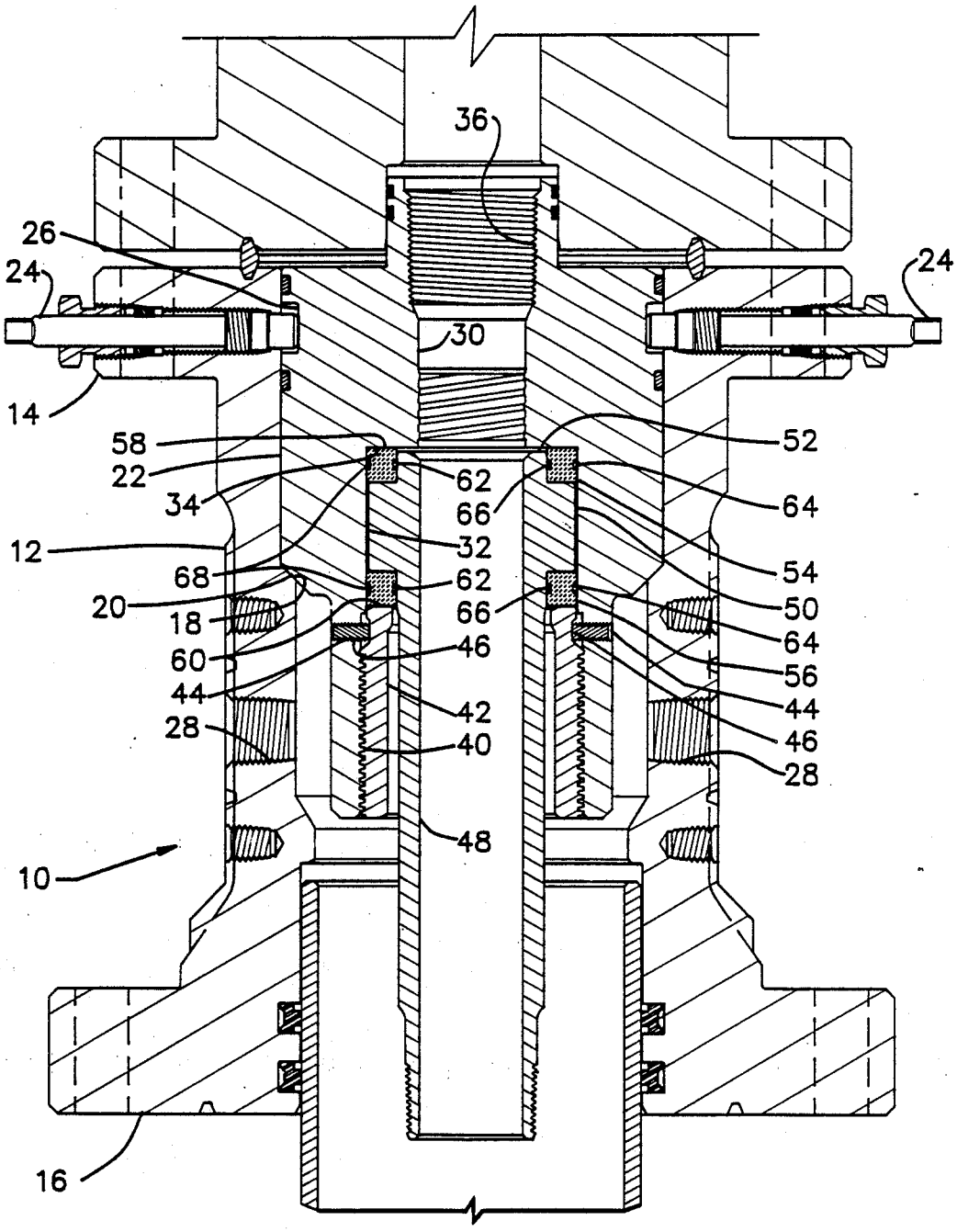
FIG. 1 is a transverse sectional view of the improved wellhead structure of the present invention.

The wellhead 10 as shown in FIGURE 1 includes the housing 12, which is in the form of a spool with flanges 14 and 16 at its upper and lower ends for connection into the wellhead stack. Internal landing seat 18 is formed on the interior of housing 12 and is adapted to receive landing shoulder 20 of hanger 22 as can be seen in the drawing. Locking pins 24 thread radially inward in upper flange 14 and are positioned to engage within groove 26 around the upper exterior of hanger 22. Suitable sealing is provided above and below groove 26 as shown. Ports 28 extend through housing 12 into the space between hanger 22 and the interior of housing 12 below landing seat 18. The exterior of housing 12 around port 28 is formed to receive a suitable fitting to provide the communication through ports 28.

Hanger 22 includes upper bore 30 and lower counterbore 32 with downwardly facing shoulder 34 therebetween. The upper portion of bore 30 is threaded at 36 to receive tubular member (not shown). The lower end of counterbore 32 is threaded at 40 to receive support sleeve 42 and locking pins 44 thread through hanger 22 to engage within outer groove 46 in the upper portion of support sleeve 42.

Hanger mandrel 48 is generally tubular in shape and includes radially extending annular flange 50 around its upper portion a preselected short distance below upper end 52. As can be seen from the drawing, the outer diameter of flange 50 is less than the inner diameter of hanger counterbore 32 so that when mandrel 48 is centered within counterbore 32 the outer surface of flange 50 is spaced from the inner surface of counterbore 32.

Annular insulating bushings 54 and 56 are positioned around the exterior of mandrel 48 immediately above and below flange 50. Upper bushing 54 is against the upper surface of flange 50 and has a greater thickness so that its upper surface 58 when engaged with shoulder 34 in hanger 22, upper end 52 of mandrel 48 is spaced below shoulder 34 of hanger 22. Lower bushing 56 is positioned between the lower surface of flange 50 and against the upper support surface 60 of support sleeve 42. Bushings 54 and 56 are preferably of a material which is both electrically insulating and has sufficient strength to transfer the tubing loading to support sleeve 42 and thus to hanger 22. Also, upper bushing 54 is sufficiently strong to maintain the upper end of hanger mandrel 48 centered with the upper portion of counterbore 32 under conditions of bending and vibration. It has been determined that certain ceramic materials are suitable and readily available for use for bushings 54 and 56. Other materials may be used provided it includes the physical and electrical characteristics specified above. Both bushings 54 and 56 include inner grooves 62 and outer grooves 64 in which suitable sealing means, such as elastomeric seal rings 66 and 68, are positioned to prevent leakage between hanger mandrel 48 and hanger 22. Both bushings 54 and 56 are positioned tightly around the exterior of mandrel 48 and have sufficient radial dimension to prevent engagement of mandrel 48 with the surface of counterbore 32. The exterior of mandrel 48 is reduced in diameter immediately below bushing 56 to further ensure that it does not come into contact with support sleeve 42. Thus mandrel 48 is completely electrically insulated from wellhead 10 and the other components of the assembly.

Figure 2:
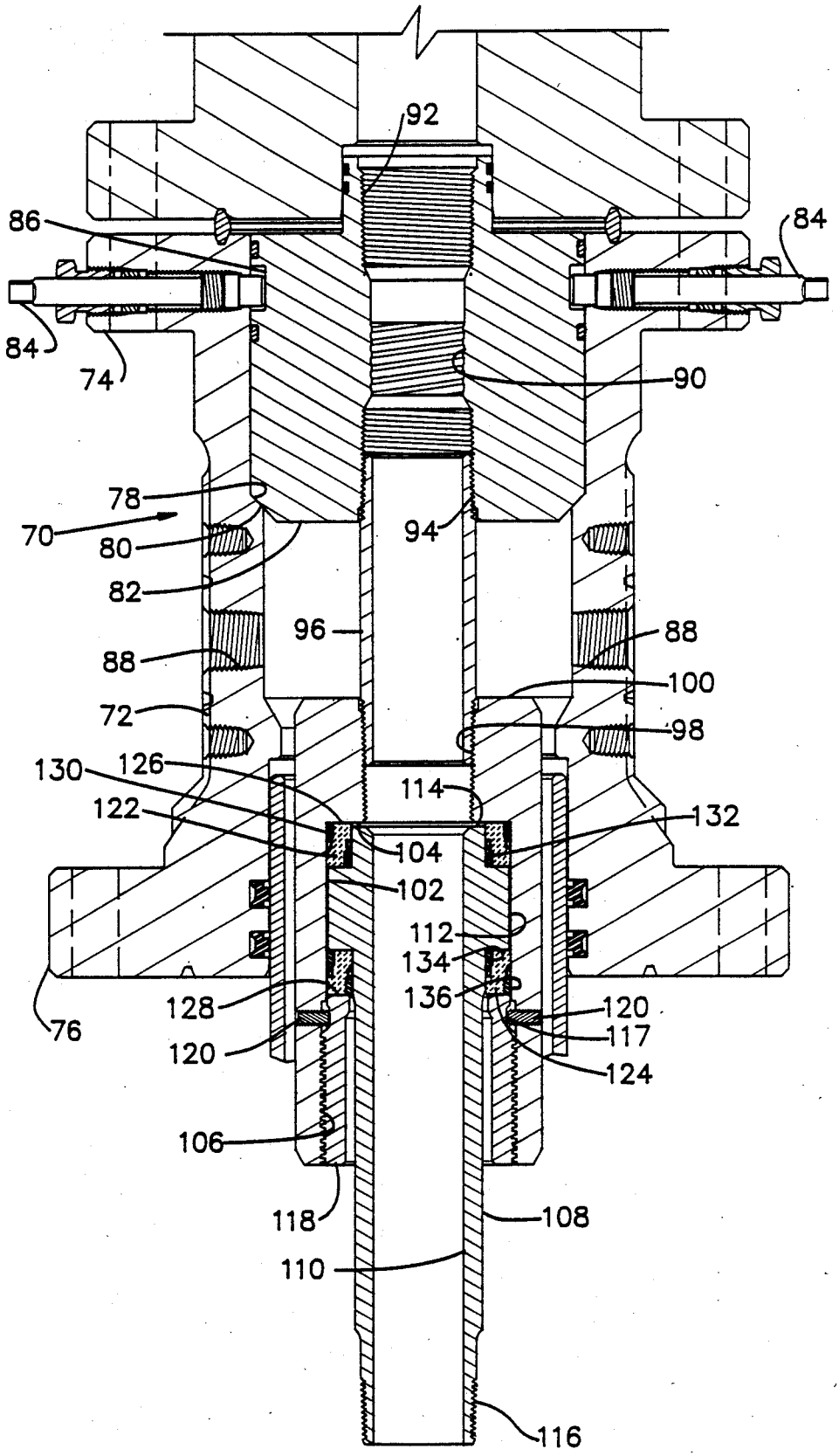
FIG. 2 is a similar sectional view of a modified form of the present invention.

In a modified form of the invention illustrated in FIG. 2, wellhead 70 is similar to wellhead 10 and includes spool housing 72 with upper and lower flanges 74 and 76 at the upper and lower ends of housing 72 for connection into the wellhead stack. Internal landing seat 78 is formed on the interior of housing 72 and is adapted to receive landing shoulder 80 of hanger 82. Locking pins 84 thread radially inward in upper flange 74 and are positioned to engage within groove 86 around the upper exterior of hanger 82. Suitable sealing is provided above and below groove 86 as shown. Ports 88 extend through housing 72 and are similar to ports 28.

Hanger 82 is generally tubular in shape and includes central bore 90 threaded at the upper end thereof at 92 and threaded at the lower end thereof at 94 for receiving tubing sub 96. Tubing sub 96 extends downward from the lower end of hanger bore 90 and engages within the upper threaded bore 98 of hanger mandrel 100.

Hanger mandrel 100 includes intermediate bore 102 below bore 98 with shoulder 104 therebetween and lower threaded bore 106. Tubing mandrel 108 is generally tubular in shape having a central bore 110 and an upper outer flange 112 spaced a preselected distance below upper end 114 of tubing mandrel 108. The lower exterior end 16 of tubing mandrel 108 is threaded to receive the upper end of a tubing string (not shown) which is to be supported thereon. Support sleeve 118 is threaded in lower threaded bore 106 of mandrel 100 and is secured in position by locking pins 120 which thread through the lower portion of hanger mandrel 100 and engage within outer groove 117 in the upper exterior of support sleeve 118.

Figure 2A:
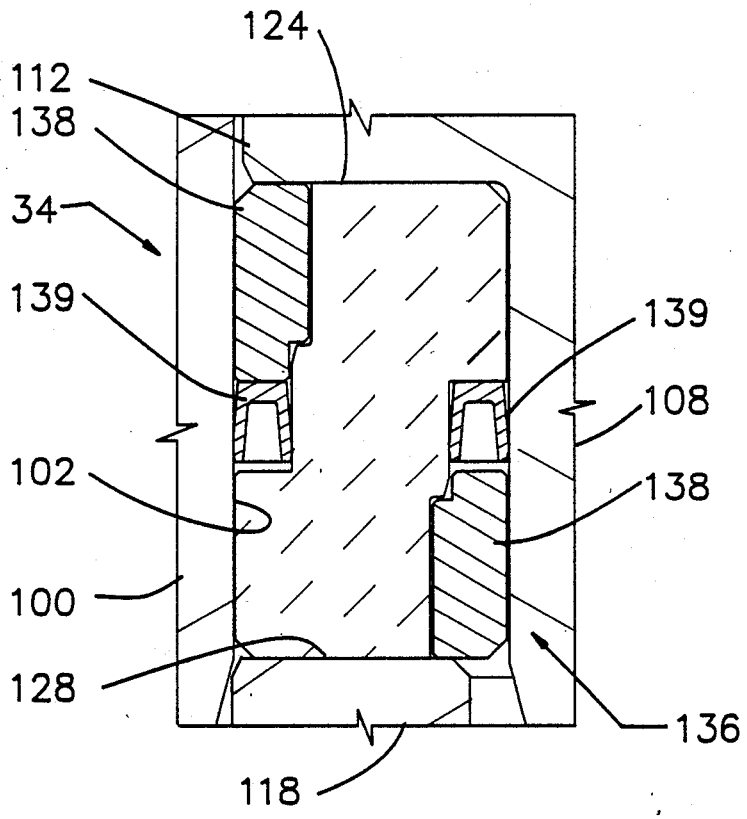
FIG. 2A is an enlarged sectional view of the bushing and its seals used in the form of the invention shown in FIG. 1.

Annular insulating bushings 122 and 124 are positioned around the exterior of mandrel 108 immediately above and below flange 112. Upper bushing 122 is against the upper surface of flange 112 and has a greater thickness than the height of the upper end 114 of tubing mandrel 108 above flange 112 so that its upper surface 126 when engaged with shoulder 104 in hanger mandrel 100, upper end 114 of tubing mandrel 108 is spaced below shoulder 103 of hanger mandrel 100. Lower bushing 124 is positioned between the lower surface of flange 112 and against the upper support surface 128 of support sleeve 118. Bushings 122 and 124 are similar in material and strength characteristics to bushings 54 and 56 as previously discussed and include suitable seals as hereinafter discussed. Seal 130 is provided around the upper exterior of bushing 122 and seal 132 is provided around the lower interior of bushing 122. Seal 134 is provided around the upper interior of bushing 124 and seal 136 is provided around the lower exterior of bushing 124 as shown in FIG. 2A. Each of the seals 130, 132, 134 and 136 include a metallic spacer ring 138 at the corners of the bushings and a cup shaped ring 139 near the mid points of the bushings with the open end of the cups of bushing 122 facing upwardly and the open end of the cups of bushing 124 facing downwardly.

Both bushings 122 and 124 fit closely around the exterior of tubing mandrel 108 and extend outwardly beyond the exterior of flange 112 to ensure that tubing mandrel flange 112 does not come into contact with the interior of intermediate bore 102 of hanger mandrel 100. In this manner bushings 122 and 124 completely insulate tubing mandrel 108 and the tubing suspended therefrom from being in contact with the wellhead 70 or other components which would interfere with the electrical insulation provided. The exterior of tubing mandrel 108 is reduced in diameter immediately below bushing 124 to further ensure that it does not come into contact with support sleeve 118.

Figure 3:
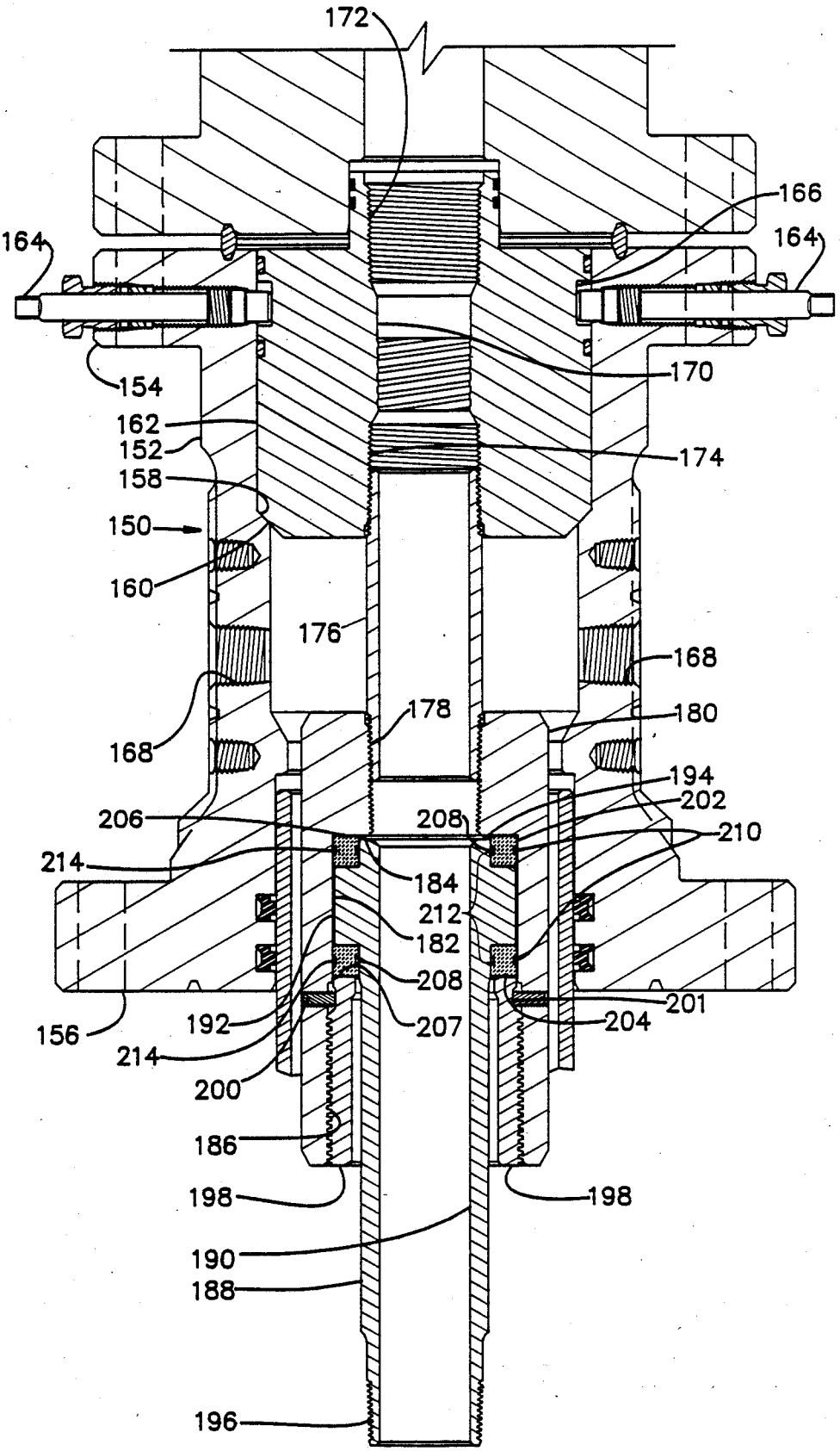
FIG. 3 is another similar sectional view of another modified form of the present invention.

In the modified form of the invention illustrated in FIG. 3, wellhead 150 is similar to wellhead 70 and includes a spool housing 152 with upper and lower flanges 154 and 156 for connection into the wellhead stack. Internal landing seat 158 is formed on the interior of housing 152 and is adapted to receive landing shoulder 160 of hanger 162 landed thereon. Locking pins 164 thread radially inward in upper flange 154 and are positioned to engage within groove 166 around the upper exterior of hanger 162. Suitable sealing is provided above and below groove 166 as shown. Ports 168 extend through housing 152 into the space between hanger 162 and the interior of housing 152 below landing seat 158.

Hanger 162 is generally tubular in shape and includes central bore 170 threaded at the upper end thereof at 172 for receiving at tubular member therein and threaded at the lower end thereof at 174 for receiving tubing sub 176. Tubing sub 176 extends downward from the lower end of hanger bore 170 and engages within the upper threaded bore 178 of hanger mandrel 180.

Hanger mandrel 180 includes intermediate bore 182 below bore 178 with shoulder 184 therebetween and lower threaded bore 186. Tubing mandrel 188 is generally tubular in shape having a central bore 190 and an outer flange 192 spaced a preselected distance below upper end 196 of tubing mandrel 188. The lower exterior end 196 of tubing mandrel 188 is threaded to receive the upper end of a tubing string (not shown) which is to be supported thereon. Support sleeve 198 is threaded in lower threaded bore 186 of mandrel 180 and is secured in position by locking pins 200 which are threaded through the lower portion of hanger mandrel 180 and engage in outer groove 201 in support sleeve 198.

Annular insulating bushings 202 and 204 are positioned around the exterior of mandrel 180 immediately above and below flange 192. Upper bushing 202 is against the upper surface of flange 192 and has a greater thickness than the height of the upper end 194 of tubing mandrel 180 above flange 192 so that its upper surface 206 when engaged with shoulder 184 in hanger mandrel 180, causes the upper end 194 of tubing mandrel 188 to be spaced below shoulder 184 of hanger mandrel 180. Lower bushing 204 is positioned between the lower surface of flange 192 and against the upper support surface 207 of support sleeve 198. Bushings 202 and 204 are similar in material and strength characteristics to bushings 54, 56, 122 and 124 as previously discussed and include suitable seals as hereinafter discussed.

Both bushings 202 and 204 are positioned tightly around the exterior of mandrel 188 and have sufficient radial dimension to prevent engagement of mandrel 188 with the surface of counterbore 182. The exterior of mandrel 188 below surface 207 is reduced in diameter to ensure that there is no incidental contact therebetween.

The sealing means used with bushings 202 and 204 are identical with the sealing means used with bushings 54 and 56. Both bushings 202 and 204 include inner grooves 208 and outer grooves 210 in which suitable sealing means, such as elastomeric seal rings 212 and 214, are positioned to prevent leakage between the interior of hanger mandrel 180 and tubing mandrel 188. The structure of the wellhead 150 shown in FIG. 3 is similar to the structure of wellhead 70 shown in FIG. 2 except that the sealing means used in wellhead 150 is similar to the sealing means used in wellhead 10.

Figure 4:
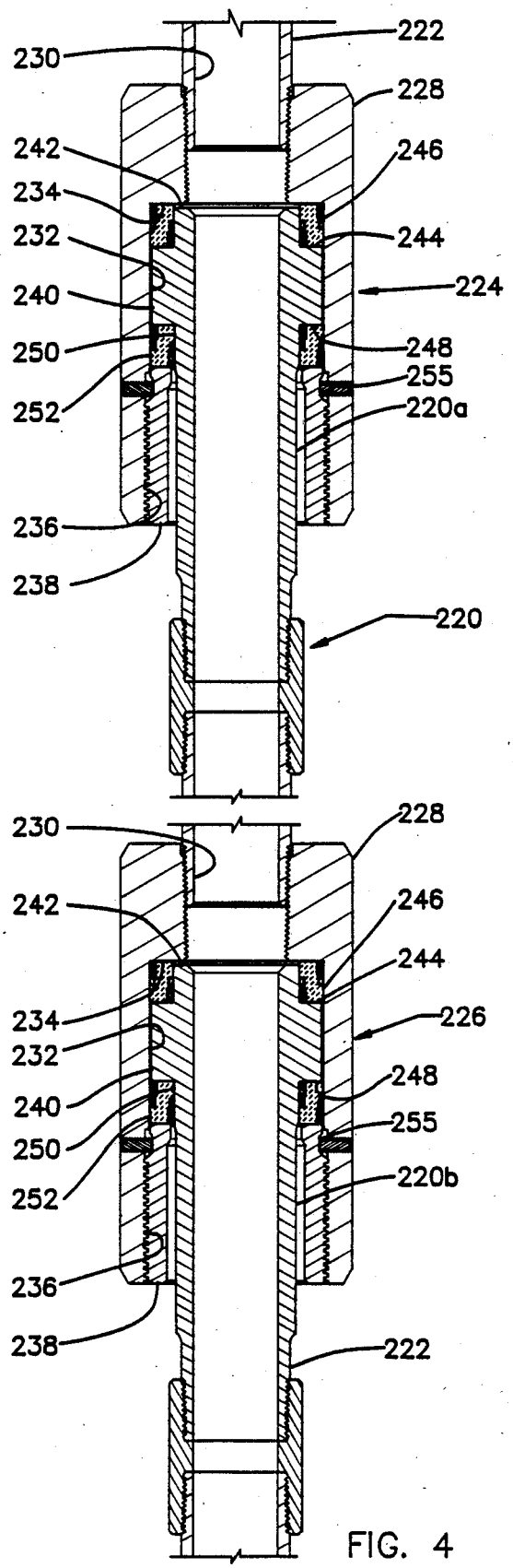
FIG. 4 is a sectional view of another modified form of the invention in which a section of a tubing string is insulated from the remainder of the string.

The structure illustrated in FIG. 4 is a sectional view of the electrical insulation of section 220 of tubing string from the remainder of string 222 through the use of two insulating couplings 224 and 226 which connect section 220 at its upper and lower end respectively to tubing string 222. Couplings 224 and 226 are identical and are given the same component numerical identification. Couplings 224 and 226 include coupling body 228 which has upper internal threads 230, first counterbore 232 below threads 230 with shoulder 234 formed therebetween and second counterbore 236 which is threaded to receive support sleeve 238. The portions 220*a* and 220*b* of tubing string 222 and section 220 include an external flange 240 immediately below upper end 242 thereof with upwardly facing shoulder 244 spaced below upper end 242 by a distance which is less than the thickness of insulating ring 246 and downwardly facing shoulder 248. The lower exterior surface 250 below shoulder 248 is maintained substantially cylindrical for the distance approximating the thickness of insulating ring 252 which engages shoulder 248 and is reduced in diameter below surface 250 to avoid incidental contact with support sleeve 238. Pins 254 are threaded through body 228 and engage in outer grooves 255 in support sleeve 238 to secure it in position once it has been properly tightened against insulating ring 252.

As can be seen, this structure allows section 220 to be completely electrically insulated from the remainder of string 222 so that any electrical operation can be completed without fear of the electrical connections being shorted into tubing string 222. Insulating rings 246 and 252 are of a suitable construction and material to provide the desired electrical insulation and to have sufficient strength to maintain the portions within the coupling bodies 224 and 226 in their desired position and to transfer the load of the weight of the tubing string 222 to the upper string so that it can be supported from above with the string in tension. Insulating rings 246 and 252 are shown to have the same design as that of insulating bushings 122 and 124 but may be similar to insulating bushings 54 and 56.

What is claimed is:

1. A wellhead structure comprising a housing having an internal landing seat, a hanger having an external landing shoulder adapted to be landed on said housing landing seat to support the hanger within the housing, said hanger having an upper bore and a lower counterbore with a downwardly facing shoulder between said bore and said counterbore, a hanger mandrel having a tubular portion and a body portion with a bore through the body portion being an extension of the bore through the tubular portion and an external radial flange extending from the body portion at a short distance below the upper end of the body portion, the outer diameter of said radial flange being smaller than the internal diameter of said hanger counterbore, said flange providing an upwardly facing shoulder on its upper surface and a downwardly facing shoulder on its lower surface, a sleeve threaded within said counterbore and having its upper end providing a support surface and having its inner diameter being larger than the outer diameter of the tubular portion of the hanger mandrel, a first annular insulating bushing positioned within said hanger counterbore above said sleeve support surface and supporting said hanger mandrel by engagement with the downwardly facing shoulder of the hanger mandrel flange, said first bushing having an outer diameter allowing it to be positioned within said hanger counterbore and an inner diameter to fit closely around the exterior of the hanger mandrel tubular portion immediately below said flange, a second annular insulating bushing positioned within said hanger counterbore and against said hanger downwardly facing shoulder and on said upwardly hanger mandrel flange upwardly facing shoulder, said second annular bushing having a thickness which is greater than the projection of said hanger mandrel body above said upwardly facing flange shoulder, and means for sealing between the exteriors and interiors of said annular bushings and the interior of said hanger counterbore and the exterior surface of said hanger mandrel.

2. A wellhead structure comprising a housing having an internal landing seat, a hanger having an external landing shoulder adapted to be landed on said housing landing seat to support said hanger within the housing, said hanger having an upper bore and a lower counterbore with a downwardly facing shoulder between said bore and said counterbore, a hanger mandrel having a tubular body and a flange extending outwardly therefrom near the upper end thereof, a first annular bushing of insulating material positioned around the upper end of said mandrel and between said hanger counterbore shoulder and the upper surface of said mandrel flange, a second annular bushing of insulating material positioned around said mandrel and below said mandrel flange within said counterbore, means secured to said hanger and providing supporting engagement of said second annular bushing, said bushings being sized to maintain said mandrel in spaced relationship to said hanger to prevent electrical contact therebetween.

3. A wellhead structure according to claim 2 wherein said bushings are ceramic bushings.

4. A wellhead structure according to claim 2 wherein said bushings have sufficient strength to maintain the spacing between said mandrel and said hanger to transfer the tubing load from said mandrel to said hanger.

5. A wellhead structure according to claim 2 including sealing means associated with each of said bushings for sealing between the exterior of said mandrel and the interior of said hanger.

6. A wellhead structure according to claim 5 wherein said sealing means includes inner and outer sealing rings positioned in grooves in the interior and exterior surfaces of said first and said second bushings.

7. A wellhead structure according to claim 6 wherein said sealing rings are elastomeric sealing rings.

8. A wellhead structure according to claim 6 wherein said sealing means includes a recess around the upper exterior of said first bushing and a recess around the lower interior of said first bushing, a recess around the upper interior of said second bushing and a recess around the lower exterior of said second bushing, a seal positioned in each of said recesses including a metallic spacer ring positioned at the corners of said bushings, and a cup-shaped metal ring positioned in said recesses with the metal cup rings in said first bushing recess facing upwardly and the metal cup rings in said second bushing recess facing downwardly.

9. A wellhead structure according to claim 2 wherein said supporting means includes a support sleeve threaded into the lower interior of said hanger counterbore.

10. A wellhead structure according to claim 2 including a tubing sub secured to said hanger, a hanger mandrel secured to the lower end of said tubing sub, and wherein said hanger mandrel has bore, counterbore and shoulder therebetween and said tubing mandrel is positioned therein.

11. A wellhead structure comprising a first tubular member having an internal landing seat, a second tubular member having an external landing shoulder adapted to be landed on said first tubular member landing seat to support said second member within the first member, said second tubular member having an upper bore and a lower counterbore with a downwardly facing shoulder between said bore and said counterbore, a mandrel having a tubular body and a flange extending outwardly therefrom near the upper end thereof, a first annular bushing of insulating material positioned around the upper end of said mandrel and between said second member counterbore shoulder and the upper surface of said mandrel flange, a second annular bushing of insulating material positioned around said mandrel and below said mandrel flange within said counterbore, means secured to said second tubular member and providing supporting engagement of said second annular bushing, said bushings being sized to maintain said mandrel in spaced relationship to said second tubular member to prevent electrical contact therebetween.

12. A well structure according to claim 11 including sealing means carried by each of said bushings for sealing against the interior of said first tubular member and against the exterior of said second tubular member.

13. A well structure comprising a first tubular member having a central bore therethrough, a counterbore below said central bore with a downwardly facing shoulder therebetween and a lower threaded bore below said counterbore, a second tubular member having an upper end and an external flange extending outwardly a short distance below the upper end with the flange having an upwardly facing shoulder and a downwardly facing shoulder, a sleeve for threading within the lower threaded bore of said first tubular member and having an upper support surface, a first bushing of electrical insulating material positioned between the downwardly facing shoulder within said first tubular member and the upwardly facing shoulder on said second tubular member flange, said first bushing being of sufficient thickness to ensure the upper end of said second tubular member is spaced below said downwardly facing shoulder within said first tubular member, and a second bushing of electrical insulating material positioned between the downwardly facing shoulder on said second tubular member flange and the upper support surface of said sleeve, said bushings having sufficient radial dimension to prevent contact between the interior of said first tubular member and the exterior of said flange and having sufficient strength to support said second tubular member within said first tubular member.

14. A well structure comprising a tubing string, a first coupling connecting to said tubing string, a section of tubing connected to said first coupling, a second coupling connecting to said section of tubing and to said tubing string, each of said couplings including a body having an internal bore and a counterbore with a downwardly facing shoulder at the upper end of such counterbore, a section of tubing having an external flange immediately below the upper end of such tubing to provide an external upwardly facing shoulder and an external downwardly facing shoulder, an upper insulating ring and a lower insulating ring, said unsulating ring being of a material providing electrical insulation and support strength, and a support sleeve secured within said body to support said lower insulating ring in engagement with said lower external downwardly facing shoulder and with said upper insulating ring engaged between said body internal shoulder and with said upwardly facing flange shoulder, said upper insulating ring being of sufficient axial dimension to space the upper end of said tubing portion below said downwardly facing body shoulder.

15. A well structure according to claim 14 wherein said insulating rings are ceramic rings.

16. A well structure according to claim 14 wherein said insulating ring have sufficient strength to maintain the spacing between the tubing portions and the bodies and to transfer the load of the weight of the tubing string to the upper end of the tubing string.

* * * * *

UNITED STATES PATENT AND TRADEMARK OFFICE

CERTIFICATE OF CORRECTION

PATENT NO. : 4,923,006

DATED : May 8, 1990

INVENTOR(S) : Michael P. Hartmann, et al

It is certified that error appears in the above-identified patent and that said Letters Patent is hereby corrected as shown below:

On the title page, the filing date should read --June 28, 1989.

Signed and Sealed this

Twenty-fifth Day of December, 1990

*Attest:*

HARRY F. MANBECK, JR.

*Attesting Officer*

*Commissioner of Patents and Trademarks*